US005803091A

United States Patent [19]

Gherardi et al.

[11] Patent Number: 5,803,091

[45] Date of Patent: Sep. 8, 1998

[54] ROLLING METHOD AND A RELATIVE DEVICE FOR FILTER TIPPING MACHINES

[75] Inventors: Gian Luigi Gherardi; Fiorenzo Draghetti, both of Medicina, Italy

[73] Assignee: G. D S.P.A., Bologna, Italy

[21] Appl. No.: 818,430

[22] Filed: Mar. 17, 1997

[30] Foreign Application Priority Data

Mar. 15, 1996 [IT] Italy ..... BO96A0143

[51] Int. Cl.[6] ..... A24C 5/10

[52] U.S. Cl. ..... 131/94; 131/84.1

[58] Field of Search ..... 131/93, 94, 95, 131/84.1

[56] References Cited

U.S. PATENT DOCUMENTS 5,390,684 2/1995 Rizzoli et al. ..... 131/94

*Primary Examiner*—Aaron J. Lewis
*Assistant Examiner*—Charles W. Anderson
*Attorney, Agent, or Firm*—IP Group of Pillsbury Madison & Sutro LLP

[57] ABSTRACT

An assembly including two lengths of cigarette rod, a double length filter and a band of gummed paper is rolled up along a path describing a limited arc to produce a double length filter tipped cigarette, passing between a cylindrical inner rolling surface and a cylindrical outer conveying surface that revolve in the same direction about respective axes, the inner surface at a greater velocity than the outer surface. The conveying surface is generated by a succession of substantially flat faces, each providing a seat shaped to accommodate a respective assembly and incorporated laterally into one of a series of rockers mounted so as to pivot between a first position, assumed along the rolling arc, in which the flat faces are directed toward the rolling surface, and a second position assumed when passing through successive infeed and outfeed stations, in which the flat faces are directed away from the rolling surface.

16 Claims, 2 Drawing Sheets

ROLLING METHOD AND A RELATIVE DEVICE FOR FILTER TIPPING MACHINES

BACKGROUND OF THE INVENTION

The present invention relates to a rolling method for filter tipping machines.

Filter tipping machines in current use are designed normally to receive a succession of double length cigarette rods from a cigarette manufacturing machine, which double length cigarette rods are cut crosswise into equal parts to produce two single lengths. The single lengths of each pair generated in this way are distanced one from another axially, opening up a space sufficient to accommodate a double length filter which combines thus with the two lengths of cigarette rod to form an "assembly" of elongated elements disposed in axial alignment one with another, such as can be joined rigidly together to produce a double length cigarette.

It is a conventional practice when fashioning double length cigarettes in this way to advance each assembly together with a band of gummed paper marginally longer than the double length filter, attached along one edge to the central portion of the respective assembly, which is wrapped around the assembled elements internally of a rolling device.

Rolling devices embraced by the prior art generally comprise a rolling drum, by which the assemblies and the respective bands of gummed paper are directed in succession into a rolling channel provided between a fixed restraint and a peripheral surface of the drum. The restraint is encompassed within a comparatively small arc of the overall circumference presented by the drum, typically 60° or thereabouts, and separated from the peripheral surface by a distance which is marginally less than the diameter of the double length filter.

As a result of the initial impact produced on engaging the fixed restraint, then of frictional contact with the restraint on the one hand and with the peripheral surface of the drum on the other, each successive assembly is forced to roll about its own axis, causing the relative band of gummed paper thus to envelop the double length filter and a portion of the cigarette rod on each side, while advancing along the rolling channel at a feed velocity equivalent to half the peripheral velocity of the drum.

Conventional rolling devices of the type described above have certain drawbacks which are attributable mainly to the ever increasing output capacity of filter tipping machines, and consequently the higher and higher speed at which the cigarette rod and filter assemblies need to be conveyed; the cigarette rods tend to break open on striking the entry end of the fixed restraint, and to empty thereafter by reason of the relatively high speeds of rotation (5000 rev/min) generated along the rolling channel.

SUMMARY OF THE INVENTION

The object of the present invention is to provide a rolling method whereby a band of gummed paper can be caused to wrap around a double length filter and the ends of the respective cigarette rods in a double length cigarette assembly, without encountering the drawbacks described above.

The stated object is realized according to the present invention in a rolling method, applicable to filter tipping machines, by which to wrap a band of gummed paper around a central portion of a cigarette assembly comprising, in addition to the band, two lengths of cigarette rod and a double length filter interposed between the two rods, in such a way as to obtain a double length filter tipped cigarette.

Such a method includes the steps of advancing the assembly continuously by means of a conveyor along a predetermined path at a first predetermined velocity, between an infeed station at which the assembly is taken up and an outfeed station at which the double length cigarette is released, and causing the assembly to roll against the respective band in contact with a rolling element providing a rolling surface that extends along a rolling leg of the path and combines with the conveyor to establish a rolling channel.

To advantage, the rolling element is a rigid element set in motion along the conveying path in the same direction as the assembly, at a second velocity other than zero and different from the first velocity.

The present invention also relates to a rolling device by means of which to implement such a method.

A rolling device according to the present invention is utilized in filter tipping machines for wrapping a band of gummed paper around a central portion of a cigarette assembly comprising, in addition to the band, two lengths of cigarette rod and a double length filter interposed between the two rods, in such a way as to obtain a double length filter tipped cigarette. The device comprises a conveyor by which the assembly is advanced continuously along a predetermined path, at a first predetermined velocity, between an infeed station at which the assembly is taken up and an outfeed station at which the double length cigarette is released, and a rolling element providing a rolling surface that extends along a rolling leg of the path and combines with the conveyor to establish a rolling channel internally of which the assembly is rolled against the respective band. The rolling element is a rigid element set in motion by drive means along the conveying path in the same direction as the assembly, at a second velocity which is other than zero and different to the first velocity.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
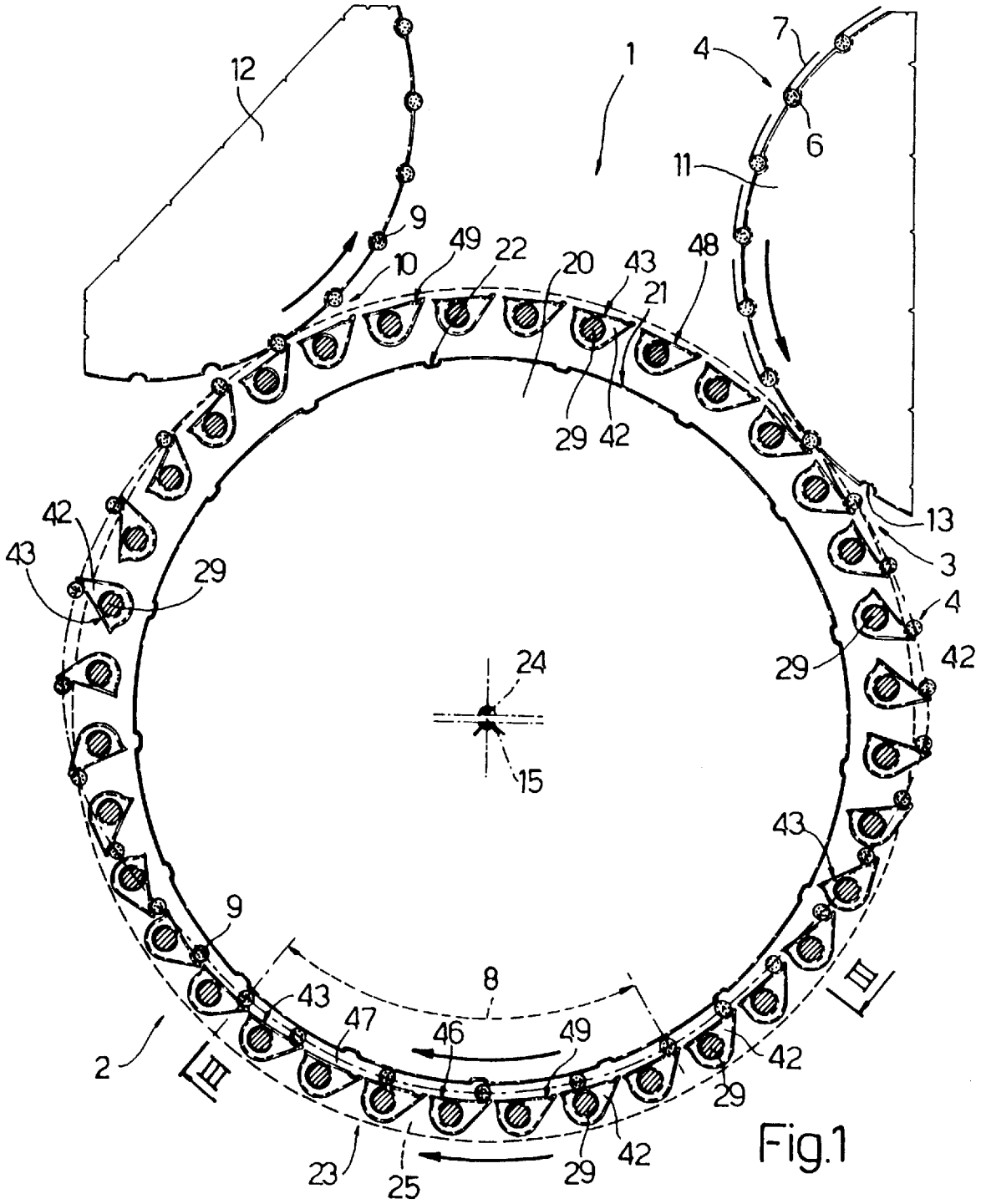
FIG. 1 shows a preferred embodiment of the rolling device according to the present invention, illustrated in a side elevation with parts in section.
Figure 2:
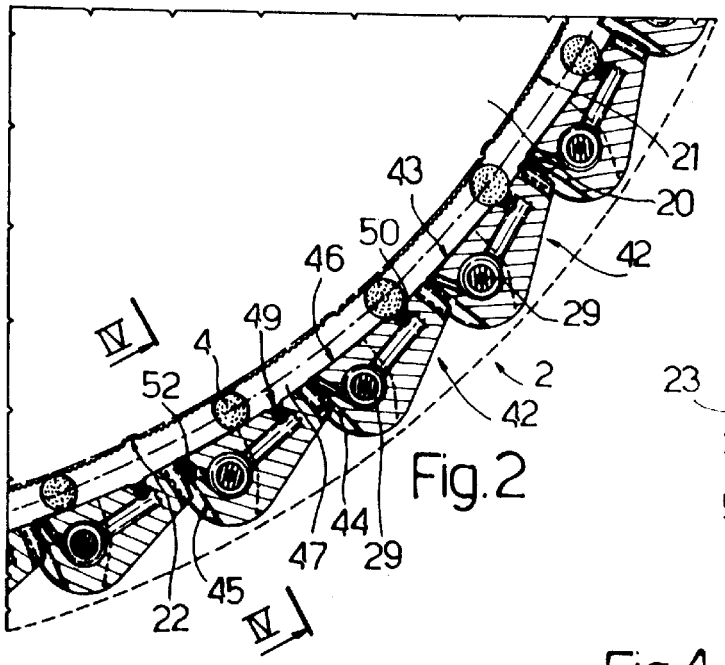
FIG. 2 is an enlarged detail of FIG. 1.

Referring to FIGS. 1 and 2 of the drawings, 1 denotes a filter-tipping machine, in its entirety, incorporating a fixed frame 1*a* (FIG. 3), and supported by the frame, a rolling unit 2 positioned to take up a succession of assemblies 4, each comprising two lengths of cigarette rod 5, a double length filter 6 separating the rods 5, and a gummed paper 7 serving to connect each rod 5 to a corresponding end of the double length filter 6, in accordance with standard practice. Directed onto the unit 2 by way of an infeed station 3, the assemblies 4 are advanced along a rolling arc denoted 8, and caused in the process to rotate in such a way that the gummed papers 7 will wrap around the respective rods 5 and double length filters 6 to form a succession of double length cigarettes 9 which are directed by the unit 2 toward an outfeed station 10.

The machine 1 further comprises an aspirating infeed roller 11 of conventional embodiment, rotatable about a respective axis (perpendicular to the plane of FIG. 1 though not indicated) in a counterclockwise direction, as viewed in FIG. 1, from which the assemblies 4 are transferred singly and in succession to the rolling unit 2 at the infeed station 3, also an aspirating outfeed roller 12 lying tangential to the unit 2 at the outfeed station 10, rotatable about a respective axis (perpendicular to the plane of FIG. 1, though not indicated) in a counterclockwise direction as viewed in FIG. 1, by which the double length cigarettes 9 are taken up singly and in succession from the unit 2.

As discernible in FIG. 1, the infeed roller 11 rotates tangentially to the rolling unit 2 at the respective station 3 and is furnished with a plurality of vacuum slots 13 distributed uniformly around the periphery, each designed to accommodate and retain one assembly 4 disposed with the relative rods 5 and double length filter 6 occupying the space afforded by the slot 13, and with the respective gummed paper 7 trailing behind, attached tangentially to the double length filter 6 and the two rods 5 along a common generator farthest removed from the slot 13.

Figure 3:
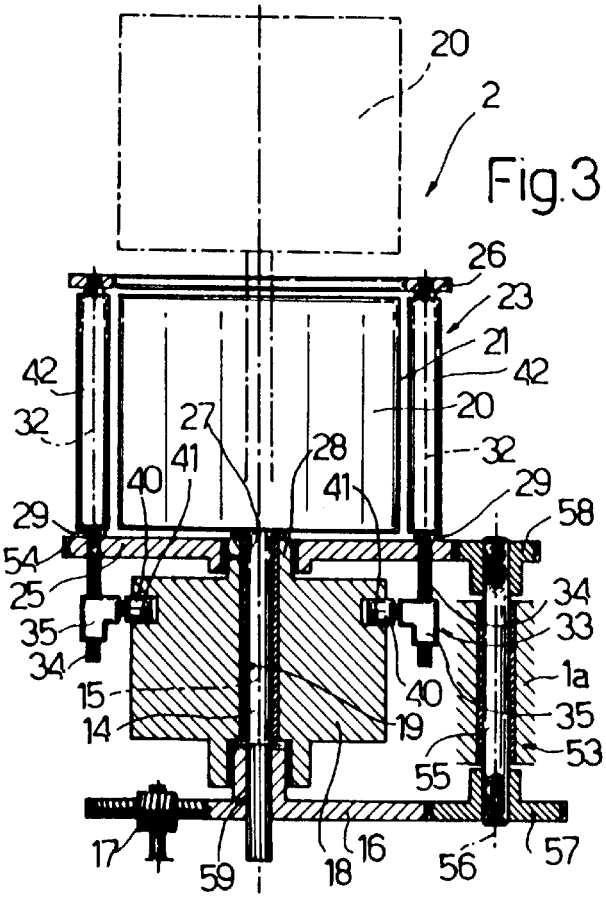
FIG. 3 is a schematic section on line III—III in FIG. 1, with parts omitted for clarity.

As indicated in FIG. 3, the unit 2 comprises a shaft 14 rotatable about an axis 15 perpendicular to the plane of FIG. 1, also a gear wheel 16 keyed to one end of the shaft 14 and engaged in mesh with a pinion 17 by which the shaft is driven in rotation about the axis 15 at a constant angular velocity, turning clockwise as viewed in FIG. 1. The unit 2 further comprises a fixed cam 18 of drum like appearance which provides a through axial hole 19 aligned coaxially with the axis of rotation 15 and freely accommodating the shaft 14, also a drum 20 rigidly associated with the end of the shaft 14 remote from the end keyed to the gear wheel 16 and compassed externally by a cylindrical rolling surface 21, which in a preferred embodiment will be milled and furnished with a plurality of rotation-inducing axial grooves 22 distributed uniformly around the periphery, although the grooves might be omitted.

Still referring to FIG. 3, the unit 2 also comprises a cylindrical cage 23 supported in conventional manner (not indicated) and rotatable about an axis 24 which, as illustrated in FIG. 1, is disposed parallel with but marginally offset from the axis 15 of the drum 20. The cage 23 comprises two rings 25 and 26 centered on the same axis 24, the first of which affording a clearance hole 27 concentric also with the axis 24 and occupied rotatably by an appendage 28 that extends axially from the cam 18, likewise concentrically with the axis 24, and is occupied in its turn by the shaft 14.

Figure 4:
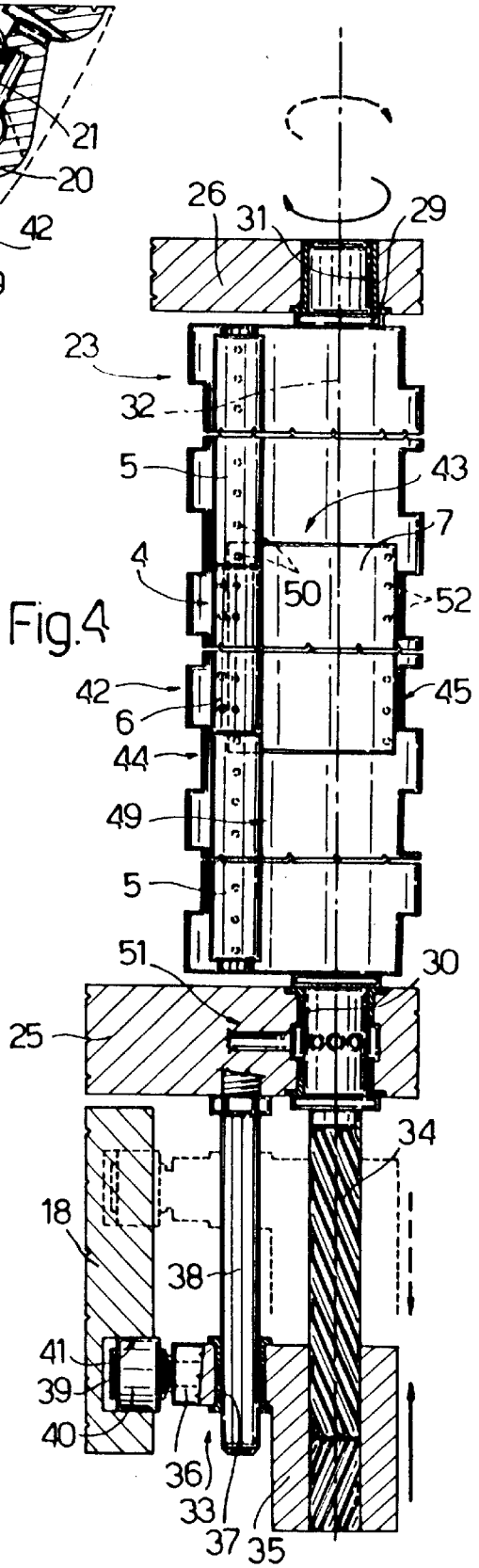
FIG. 4 is an enlarged section on IV—IV in FIG. 2.

As illustrated to better advantage in FIG. 4, the two rings 25 and 26 are interconnected by a plurality of shafts 29, each of which disposed with its opposite ends anchored rotatably in relative sockets 30 and 31 afforded respectively by the two rings 25 and 26 and rotatable thus about a corresponding axis 32 parallel to the two central axes 15 and 24. The end of each shaft 29 occupying the socket denoted 30 is coupled to an actuator device 33 by which the shaft 29 itself can be made to rock on its axis 32; the device 33 operates in conjunction with the cam 18 and further comprises a multiple thread screw 34 rigidly associated with the shaft 29 and rotatable about the same axis 32, also a lead nut 35 coupled with the screw 34 and presenting a radial appendage denoted 36. The appendage 36 provides a clearance hole 37 disposed parallel to the screw 34, slidably accommodating a rotation-inhibiting rod 38 associated rigidly with the ring 25, and carries a pivot 39 extending at right angles to the screw 34 on which to mount a freely rotatable following roller 40 located in an annular groove 41 provided by the cam 18 and encircling the axis 15 of rotation.

With reference to FIGS. 2 and 4 of the drawings, each shaft 29 carries a keyed rocker element 42 exhibiting what is essentially a peardrop transverse profile, of which one side presents a substantially flat face 43 parallel with the axis 32 of the shaft; the rocker 42 appears essentially rectangular in plan (FIG. 4), with a longitudinal axis positioned parallel and laterally offset relative to the axis 32 of the shaft. The flat face 43 of the rocker 42 is compassed laterally by two opposite longitudinal edges affording respective sets of teeth 44 and 45 staggered one from another.

Each rocker 42 is caused by the relative actuator device 33 to rotate about the relative axis 32 between two angular positions 180° apart. In a first of these two positions, the flat face 43 is directed toward the drum 20, in such a way as to generate a segment of a concave cylindrical surface 46 centered on the axis 24 of the cage 23, directed toward the rolling surface 21 and combining with this same surface 21 to establish a rolling channel 47; as discernible from FIG. 2, the teeth 44 of one rocker 42 are designed to interlock with the teeth 45 of the next and thus to maintain the continuity of the concave surface 46. In the second position, rotated 180° about the shaft 29, the flat face 43 is directed away from the rolling surface 21 to form a segment of a convex cylindrical surface 48 centered on the axis 24 of the cage 23, the teeth 44 of one rocker 42 again interlocking with the teeth 45 of the next to maintain continuity of the surface 48.

The flat face 43 of each rocker 42 incorporates a longitudinal seat 49 extending adjacent to one set of teeth 44, parallel to the axis 32 of the shaft 29, and designed to accommodate a single assembly 4 which is held in place by a line of holes 50 forming part of a conventional suction device 51. The shaft 29 functions as a rotating coupler for the suction device 51, which also comprises a second line of holes 52 extending adjacent to the opposite set of teeth 45 and operating in conjunction with certain of the first holes 50 to keep the gummed paper 7 of the relative assembly 4 in contact with the flat face 43 by restraining the two opposite edges of the band.

Referring again to FIG. 3, the unit 2 comprises drive means 53 connecting with the gear wheel 16 on the one hand and with an external tooth profile 54 provided by the nearer ring 25 on the other; such means 53 include a shaft 55 supported by the frame 1*a*, rotatable about an axis 56 parallel with the axis 15 of the drum 20, a first gear 57 keyed to the shaft 55 and in mesh with the gear wheel 16, and a second gear 58 keyed to the shaft 55 and in mesh with the tooth profile 54. The drive means 53 are arranged in such a way as to set the surfaces 21 and 46 of the channel 47 in rotation in the same direction about their respective axes 15 and 24, and proportioned such that the cage 23 will rotate at an angular velocity less than the angular velocity of the drum 20 driven by the shaft 14.

Still referring to FIG. 3, the shaft 14 is associated with the gear wheel 16 by way of an axially slidable coupling 59 that enables the drum 20 to be distanced axially from the cage 23 for the purposes of cleaning, maintenance or product changeover.

The operation of the unit 2 will now be described, following the progress of a single rocker 42 from the moment of its passage, with the cage 23 rotating at a uniform angular velocity about the relative axis 24, beyond the outfeed station 10 and toward the infeed station 3 at the same constant velocity.

At this stage the rocker 42 is positioned with the flat face 43 directed away from the axis 24, thus combining with the surfaces 43 of adjacent rockers 42 as described above to generate the convex surface 48, which revolves substantially tangential to the two aspirating rollers 11 and 12 at the corresponding stations 3 and 10. The rocker 42 continues to advance in this position, with the set of teeth denoted 44 forwardmost, and enters the infeed station 3 with the longitudinal seat 49 timed to encounter a slot 13 of the relative roller 11, whereupon an assembly 4 is transferred in conventional manner to the seat 49 and retained.

More precisely, as indicated in FIG. 4, the assembly 4 is caused to settle on the rocker 42 with the relative gummed paper 7 spread across the flat face 43 and held in place through the effect of suction generated by the relative device 51 via the holes 52 on the one side and certain of the holes 50 on the opposite side, and with the cigarette rods 5 and the double length filter 6 occupying the seat 49.

Having cleared the infeed station 3, the rocker 42 is caused to pivot counterclockwise about its axis 32 of rotation by the corresponding actuator device 33, of which the lead nut 35 will be translated axially by the cam 18 in such a way that the respective screw 34 and the associated shaft 29 are forced to rotate. The rocker 42 completes a rotation of approximately 180° about the relative axis 32 before entering the rolling arc 8, with the result that the flat face 43 assumes and remains in a position addressing the surface 21 of the drum, combining with the surfaces 43 of adjacent rockers 42 to generate the concave surface 46.

Within the compass of the rolling arc 8, this same surface 46 combines with the surface 21 of the drum to establish a rolling channel 47 which, given that the two surfaces 46 and 21 are not concentric, provides an entry gap and an exit gap of width marginally greater than the diameter of the assemblies 4, and a tighter intermediate section of width marginally less than the diameter of the assemblies 4. Thus, when carried into the channel 47 by the respective rocker 42 and brought gradually into contact with the revolving surface 21 of the drum, which turns in the same direction as the rocker 42 but at a greater velocity, the assembly 4 is forced from the seat 49 and rolled against the flat face 43, following an arcuate trajectory concentric with the axis 15 of the drum and advancing, relative to the rocker 42, at a velocity half way between the peripheral velocities of the two revolving surfaces 21 and 46.

As discernible in FIG. 4, the rolling action induced between the assembly 4 and the flat face 43 of the relative rocker 42 is in itself sufficient to complete the formation of the double length cigarette 9; this said, best results are achieved when the difference between the velocities of the two surfaces 21 and 46 is relatively small, and yet great enough to ensure that the assembly 4 will complete two full revolutions about its own axis when passing along the channel 47. Upon completion of the rolling step, the double length cigarette 9 exits the channel 47 no longer associated with the rocker 42 occupied initially by the respective assembly 4, but occupying the seat 49 provided by the rocker 42 two places forward in the direction followed by the cage 23.

Once beyond the end of the channel 47, the rocker 42 pivots clockwise about its axis 32 of rotation, in such a way as to divert the double length cigarette 9 away from the concave surface 46 and onto the convex surface 48 in readiness for transfer to the second suction roller 12 at the outfeed station 10.

Advantageously, in the rolling unit 2 described and illustrated, both of the rolling surfaces 21 and 46 are rigid in embodiment and capable of generating an extremely precise rolling action on the assembly 4; also, the angular velocity with which the assemblies 4 rotate about their axes during the rolling operation is dependent not on the peripheral velocity of the conveying medium provided by the cage 23, but simply on the difference between the velocities of the two surfaces 21 and 46. Even in the context of an ultra high speed filter-tipping machine 1, accordingly, the unit 2 disclosed can be operated at relatively low rolling speeds unlikely to inflict any damage whatever on the finished double length cigarettes 9.

It will be evident that changeover operations are made extremely simple in the rolling unit 2 according to the invention, given the ease with which the equipment can be set up to operated with assemblies 4 comprising cigarette rods 5 and filters 6 of different diameters. In effect, it is sufficient to remove the drum 20 and fit another of different diameter in order to obtain a rolling channel 47 of the appropriate depth.

What is claimed is:

1. A rolling method for filter tipping machines, by which to wrap a band of gummed material around a central portion of an assembly, including in addition to the band, two lengths of cigarette rod and a double length filter interposed between the two rods, in such a way as to obtain a double length filter tipped cigarette, comprising the steps of:

advancing the assembly continuously by use of a conveyor, along a predetermined path, at a first predetermined velocity, between an infeed station at which the assembly is taken-up, and an outfeed station at which the double length cigarette is released, and causing the two lengths of cigarette rod and double length of filter of the assembly to roll against a respective band of gummed material, in contact with a rolling element which provides a rolling surface that extends along a rolling let of said path and combines with said conveyor to establish a rolling channel, said rolling element being a rigid element, and said causing includes setting said rigid element in motion along said path in the same direction as said assembly, at a second velocity which is different from zero and greater than said first predetermined velocity.

2. The method as defined in claim 1, wherein:

as part of said advancing each assembly is caused by said conveyor to describe a substantially concave trajectory at least within the compass of said rolling leg, which trajectory appears as an arc, while said rolling surface appears as a convex inner surface having a radius of curvature which is shorter than that of said substantially concave trajectory.

3. The method as defined in claim 2, wherein:

said rolling channel is created between an inner rolling surface of cylindrical geometry and a cylindrical outer surface, both of which are revolving in a same direction about respective axes, said inner rolling surface at a velocity which is greater than that of said cylindrical outer surface.

4. The method as defined in claim 3, wherein:

said inner rolling surface and said cylindrical outer surface are disposed eccentrically in relation to one another, thereby creating a channel having an entry section and an exit section each having a transverse dimensions which is substantially equal to the diameter of the assembly and an intermediate section having transverse dimensions which are marginally less than said diameter.

5. The method as defined in claim 3 or 4, wherein:

said outer cylindrical surface is a transport surface presented by the conveyor and comprises a succession of substantially flat faces, each providing a seat arranged to admit a respective said assembly and incorporated laterally into a rocker which is rotatable alternately between a first position, assumed along said rolling channel, in which the respective flat face is directed toward said inner rolling surface, and a second position assumed when passing through said infeed and outfeed stations in which the respective flat face is directed away from said rolling surface.

6. A rolling device for filter tipping machines, for wrapping a band of gummed paper around a central portion of a cigarette assembly, for each of a succession of like cigarette assemblies, each of which includes, in addition to the band, two lengths of cigarette rod and a double length filter interposed between the two rods, in such a way as to obtain a double length filter tipped cigarette, said device comprising:

a conveyor by which each assembly is advanced continuously along a predetermined path at a first predetermined velocity, between an infeed station at which each assembly is taken-up, and an outfeed station at which the respective double length cigarette is released, and a rolling element providing a rolling surface which extends along a rolling leg of said path and combines with said conveyor to establish a rolling channel in which the two lengths of cigarette rod and double length of filter of each assembly is rolled in succession against a respective band of gummed paper to create the respective assembly wherein said rolling element is a rigid element which is arranged to be set in motion by respective drive means along said conveying path in the same direction as each said assembly in succession, at a second velocity which is different from zero and greater than said first velocity.

7. The device as defined in claim 6, wherein:

said conveyor is arranged to cause each said assembly in succession to describe a substantially concave trajectory at least within the compass of said rolling leg, which concave trajectory appears as an arc, said rolling surface having a convex inner surface having a radius of curvature which is shorter than that of said concave trajectory.

8. The device as defined in claim 7, wherein:

said rolling channel being defined between an inner rolling surface having a cylindrical geometry and a cylindrical outer surface, said drive means being arranged to cause said inner rolling surface and said cylindrical outer surface to revolve in a same direction about respective axes, said inner rolling surface at a velocity which is greater than that of said cylindrical outer surface.

9. The device as defined in claim 8, wherein:

said inner rolling surface and cylindrical outer surface are disposed eccentrically relative to one another, defining a channel having an entry section and an exit section of which the transverse dimensions become progressively narrower toward an intermediate section of said channel.

10. The device as defined in claim 8 or 9, wherein:

said cylindrical outer surface is a transport surface provided by said conveyor and comprising a plurality of rockers, each presenting a substantially flat lateral face, and actuator means by which each said rocker is made to rotate alternately between a first position assumed along the rolling channel, in which the respective said flat face is directed toward said inner rolling surface, and a second position assumed at said infeed and outfeed stations in which the respective said flat face is directed away from said rolling surface, and in such a way that said flat faces, when advancing along the rolling channel occupy said first position and align with one another to define said cylindrical outer surface, while those of said flat faces which lie between said infeed and outfeed stations and occupy said second position align one with another to establish a further surface lying externally of and substantially concentric with said cylindrical outer surface.

11. The device as defined in claim 6, wherein:

said conveyor comprises a hollow cylindrical cage, and said rolling element comprises a drum which is accommodated internally of said cage.

12. The device as defined in claim 11, wherein:

said drum is coupled to said cage in rotatable and axially slidable association.

13. The device as defined in claim 11 or 12, wherein:

said drum is rotatable about a first axis, is furnished with an outer cylindrical service that functions as said rolling surface, and is coupled to drive means in such a way as to rotate about said first axis in a predetermined direction and at a first predetermined angular velocity, and said hollow cylindrical cage is rotatable about a second axis which is parallel to said first axis, is positioned eccentrically in relation to said drum and is coupled to said drive means in such a way as to rotate about said second axis in a same direction as said drum and at a second angular velocity which is less than said first velocity.

14. The device as defined in claim 13, wherein said hollow cage comprises:

a first annular body and a second annular body disposed coaxial with one another and with said second axis;

a plurality of shafts extending between and coupled to said first and second annular bodies, and rotatable as a result in relation to said two annular bodies about respective third axes which are distributed uniformly about said second axis;

a plurality of rockers keyed one to each said shaft, each said rocker presenting a respective flat lateral face providing a longitudinal seat designed to accommodate a respective said assembly; and actuator means coupled to each said shaft, for causing the respective said shaft to rotate alternately about the respective said third axis between a first position in which the respective said flat face is directed into said cage and toward said rolling surface and a second position in which the respective said flat face is directed away from said cage.

15. The device as in claim 14, wherein:

each said flat face is arranged to combine when occupying said first position and united with at least one adjacent said flat face, to establish a substantially cylindrical concave surface centered on said second axis, and when occupying said second position and united with at least one adjacent said flat face, to establish a substantially cylindrical convex surface centered on said second axis and tangential to said infeed and outfeed stations.

16. The device as defined in claim 15, wherein:

said rockers each have longitudinal side edges provided with sets of teeth arranged to interlock with respective teeth of adjacent ones of said rockers and thus cause said concave and convex surfaces to be substantially continuous.

* * * * *